United States Patent [19]

Cole

[11] 4,210,198

[45] Jul. 1, 1980

[54] WHEEL-BAND TYPE CONTINUOUS CASTING APPARATUS

[75] Inventor: Joseph I. Cole, Staten Island, N.Y.

[73] Assignee: Nassau Recycle Corporation, Staten Island, N.Y.

[21] Appl. No.: 19,542

[22] Filed: Mar. 12, 1979

[51] Int. Cl.[2] ..... B22D 11/06

[52] U.S. Cl. ..... 164/433; 164/435

[58] Field of Search ..... 164/87, 433, 434, 435

[56] References Cited

U.S. PATENT DOCUMENTS

| | | | |
|---|---|---|---|
| 3,528,479 | 9/1970 | Cole et al. | 164/155 |
| 3,575,231 | 4/1971 | Lenaeus | 164/433 X |
| 3,868,989 | 3/1975 | Properzi | 164/434 |
| 3,987,536 | 10/1976 | Figueres et al. | 164/87 X |

*Primary Examiner*—Robert D. Baldwin

*Assistant Examiner*—Gus T. Hampilos

*Attorney, Agent, or Firm*—Robert B. Kennedy

[57] ABSTRACT

Continuous casting apparatus is disclosed having a rotatable casting wheel 10 formed with an annular groove 12 in the wheel rim and an endless metallic band 20 mounted for movement along an endless path passing over and in contact with the casting wheel rim. Means 15, 17, 18, 19 are provided for introducing molten metal 16 into the casting wheel groove 12 under the endless band 20. A band hold-down roller 25 biases the band 20 firmly against the casting wheel rim overlaying the casting wheel groove 12. The hold-down roller 25 has an annular groove 26 located over the casting wheel groove into which an arched portion 21 of the endless metallic band 20 may intrude upon being heated by molten metal introduced into the casting wheel groove and thermally expanded.

4 Claims, 2 Drawing Figures

WHEEL-BAND TYPE CONTINUOUS CASTING APPARATUS

TECHNICAL FIELD

This invention relates to continuous casting apparatus of the type employing a casting wheel.

BACKGROUND OF THE INVENTION

As exemplified by U.S. Pat. No. 3,528,479, which is assigned to the assignee of the present invention, continuous casting apparatus has heretofore been devised which employs a rotatable wheel having an annular groove in the wheel rim into which molten metal is gravity fed. An endless band is mounted for movement along an endless path that extends over a portion of the wheel rim and groove to hold the molten metal in the groove as the wheel rotates. During rotation of the wheel and band the molten metal is cooled by water sprayed on the mold formed by the grooved casting wheel rim and band combination whereupon the metal solidifies. The casting is then stripped from the wheel in bar form at a point where the band in its endless travel leaves the casting wheel before it has rotated back to the point at which molten metal is being continuously gravity fed into the rim groove. The casting may then be fed to a rolling mill.

One persistant problem associated with the just described casting apparatus is that of the structural integrity and useful life of the endless band. This band, which typically is formed of hot rolled steel, is subjected to extremely high temperatures since it actually comes into contact with molten metal present within the casting wheel groove. However, it is only the central portion of the band that is brought into direct contact with the molten metal since the band side portions are in intimate sealing engagement with the wheel rim shoulders to each side of the rim groove. As water is sprayed onto the wheel and band to effect a cooling of the molten metal during wheel rotation, the wheel itself, including the two rim shoulders, are at a temperature substantially cooler than that of the solidifying molten metal. As a result the side portions of the band which overlay the wheel rim shoulders are similarly at a cooler temperature than that of the central portion. The band thus has a lateral temperature differential gradiant while in contact with the casting wheel which causes the central portion of the band to arch radially outwardly from the wheel upon thermal expansion rather than merely expand laterally. Since side portions of this arch overlay a portion of the rim shoulders adjacent the groove, some spacing between rim and band is created beside the groove into which molten metal may flow and form flashing during casting operations.

To prevent formation of this flashing a band hold-down roller has heretofore been located adjacent the point at which molten metal is gravity fed into the casting wheel groove. The band hold-down roller spring biases the metal band firmly against the wheel rim as it comes into initial contact with the rim whereupon the band forms a seal with the rim shoulder to each side of the groove. The just described solution to the problem of spacings forming over the rim shoulders has, unfortunately, led to the creation of a different problem. In forcing the arched metal band into intimate contact with the entire shoulder area of the casting wheel rim the cylindrical roller flattens the metallic band at this point along its endless travel. Once the band passes beyond the hold-down roller however it again assumes an arched configuration due to thermal expansion while it remains in contact with the molten metal within the wheel groove and therebeyond in its travel. Since here the molten metal is solidifying this re-arching of the band has not tended to result in any significant flow of the metal laterally onto the rim shoulders and form flashing. What does occur is a cyclically arching and flattening of the band under the alternating influences of thermal expansion and mechanical compression during each revolution of the band. This has resulted in rapid metal fatigue of the band necessitating frequent replacements.

In addition to rapid metal fatigue, some of the endless bands have also tended to slide or "walk" off of the idle and casting wheels due to excessive band camber. Those bands with significant camber will not maintain accurate alignment when rotated over the idle and casting wheel rims. It therefore is to these general problems which the present invention is primarily directed.

SUMMARY OF THE INVENTION

In one form of the invention a continuous casting apparatus is provided having a rotatable casting wheel formed with an annular groove in the wheel rim and an endless metallic band mounted for movement along an endless path passing over and in contact with a portion of the casting wheel rim. The apparatus includes means for introducing molten metal into the casting wheel groove under the endless band and a band hold-down roller biasing the band firmly against the casting wheel rim overlaying the casting wheel groove. The band hold-down roller itself has an annular groove located over the casting wheel groove into which an arched portion of the endless metallic band may intrude upon being heated by molten metal introduced into the casting wheel groove and thermally expanding.

DETAILED DESCRIPTION

Figure 2:
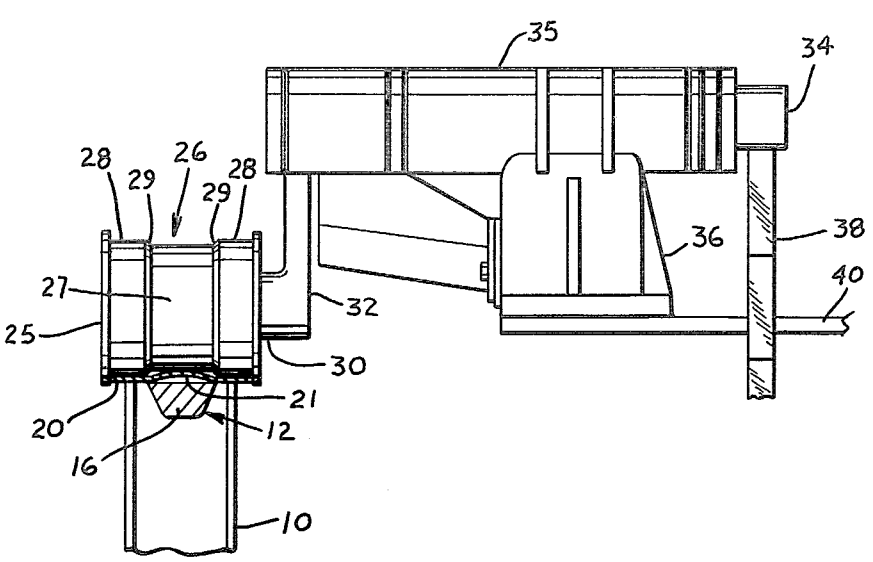
FIG. 2 is a side elevational view of the hold-down roller assembly component of the apparatus shown in FIG. 1 with a portion of the casting wheel shown diagrammatically.

Referring now in more detail to the drawing, there is shown a continuous casting apparatus for casting metal bars which comprises a casting wheel 10 mounted for rotary movement about a shaft 11. The casting wheel has an annular groove 12 of generally trapezoidal cross-section as illustrated in FIG. 2 in a molten metal filled configuration, which groove is formed centrally in the wheel rim between two cylindrical rim shoulders 14. A tundish 15 is mounted over the casting wheel which constitutes a reservoir for supplying molten metal 16, such as copper, into the casting wheel groove 12 through a spout 17. The tundish itself is supplied with molten metal from a holding furnace 18 through a spout 19.

An endless band 20, such as one made of AISI No. 1010 hot rolled steel, is routed tautly over an idle wheel 22 positioned above the casting wheel and also over the rim of the casting wheel itself coming into initial contact with the casting wheel rim at a point just beneath the tundish spout 17. At this point of initial contact of the band with the casting wheel is mounted a band hold-down roller 25 which also has an annular groove 26 located between two cylindrical shoulders 28. In other words, the band hold-down roller 25 has an annular groove 26 defined by the two cylindrical shoulders 28 and an intermediate cylindrical roller section, defining a floor 27, having a reduced diameter relative to the diameters of the two cylindrical shoulders. In FIG. 2 it is seen that the width of the hold-down roller groove 26 is substantially the same as the width of the casting wheel groove 12, where measured at the groove entrances, and that the casting wheel and hold-down roller grooves are in radial alignment. The floor 27 of the hold-down roller groove is located radially inwardly from shoulders 28 a distance sufficient to receive a central portion of band 20 once it has arched from thermal expansion occasioned by contact with molten metal.

The hold-down roller is mounted by unshown bearings for rotatable movement about a shaft 30 which projects aside a swing arm 32. This arm is in turn connected with another shaft 34 rotatably mounted with a housing 35 that is rigidly secured to a mount 36. The upper end of a leaf spring 38 is joined to the shaft 34 while its lower end is lodged within a passage in frame 40 upon which the mount 36 is supported. The leaf spring thus biases the hold-down roller firmly against the casting wheel rim and endless band.

Figure 1:
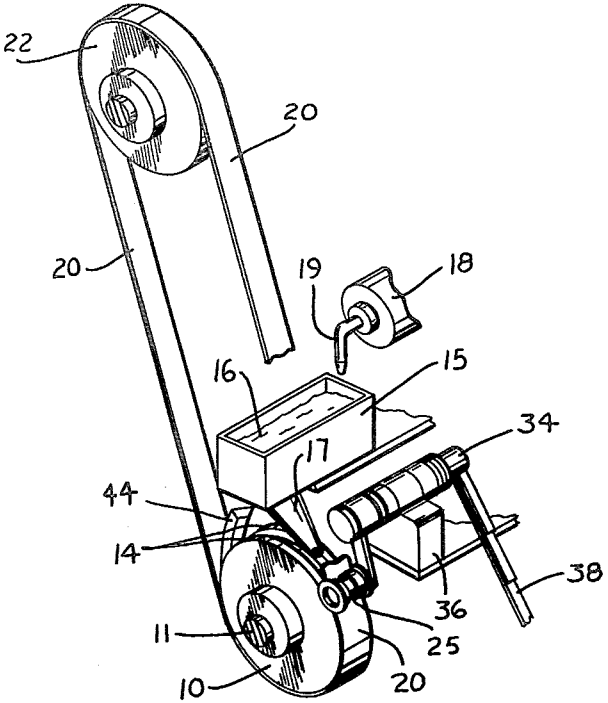
FIG. 1 is a diagrammatical view, in perspective, of a continuous casting apparatus embodying principles of the invention in one preferred form.

In operation, the casting wheel 10 is rotatably driven clockwise, as viewed in FIG. 1, thereby driving the endless band 20 clockwise along its endless path of travel over the casting and idle wheels. Molten metal 16 is gravity fed from the tundish 15 through spout 17 into the casting wheel groove 12. Just beyond this introductory point the band 20 is brought into flush contact with the casting wheel rim shoulders thereby sealing the molten metal filled groove. The combination of casting wheel and band thus serve as a sealed mold from here to the point at which the band departs the casting wheel. Water is sprayed onto the wheel and band by unshown spray means to effect cooling whereupon the molten metal solidifies sufficiently to emerge from the casting wheel groove just beyond the point at which the band 20 leaves the casting wheel rim as a flexible but solidly cast bar 44.

As the central portion of the band 20 comes into direct contact with the molten metal it forms an arch 21, here depicted exaggerated and spaced slightly from the metal 16 for clarity purposes only, which intrudes into the hold-down roller groove 26. At the same time the roller shoulders 28 hold the side portions of the band flush against the shoulders of the casting wheel rim thereby providing a lateral seal which prevents the molten metal from oozing laterally out of the groove. Should the band tend to walk laterally over the shoulders the inclined sides 29 of the roller groove 26 will cradle the band arch thereby maintaining the band in proper alignment since orientation of these sides is comparable with the sides of the band arch 21. The band substantially retains this arched configuration after it departs the casting wheel, even though it is cooled significantly by the water spray, and even throughout its travel to and from the idle wheel due to the extremely high temperatures to which it is raised by direct contact with the molten metal. As a result there is no alternate arching and flattening of the band which would rapidly produce metal fatigue leading to fractures and structure failure. The band life is therefore prolonged.

It is thus now seen that the provision of the groove in the band hold-down roller performs dual functions here. It enables the band to maintain its arched configuration while still performing its task of preventing the formation of flashing at the entry point of the molten metal into the casting wheel groove. It also aligns the band with the casting wheel rim.

It should be understood that the just described embodiment merely illustrates principles of the invention in one preferred form. Many additions, deletions and modifications may, of course, be made thereto without departure from the scope of the invention as set forth in the following claims.

What is claimed is:

1. A continuous casting apparatus having a rotatable casting wheel formed with an annular groove in the wheel rim, an endless metallic band mounted for movement along an endless path passing over and in contact with a portion of the casting wheel rim, means for introducing molten metal into the casting wheel groove under the endless band, and a band hold-down roller biasing the band firmly against the casting wheel rim overlaying the casting wheel groove and with said band hold-down roller having two cylindrical shoulders upon which said band is directly supported and an intermediate cylindrical roller section of reduced diameter relative to the diameters of said two cylindrical shoulders defining an annular roller groove straddled by said two shoulders forming a continuous gap between said shoulders of said hold-down roller into which gap an arched portion of the endless metallic band may intrude upon being heated by molten metal introduced into the casting wheel groove and thermally expanding.

2. The improvement in a continuous casting apparatus in accordance with claim 1 wherein adjacent portions of the casting wheel groove and the band hold-down roller groove are of substantially the same width.

3. The improvement in a continuous casting apparatus in accordance with claim 1 or 2 wherein the casting wheel groove and the band hold-down roller groove are in substantially radial alignment.

4. The improvement in a continuous casting apparatus in accordance with claim 1 wherein said roller groove has a floor from opposite sides of which side walls divergently extend to said shoulders to cradle the band arched portion.

* * * * *

Disclaimer 4,210,198.—*Joseph Ignatius Cole,* Staten Island, N.Y. WHEEL-BAND TYPE CONTINUOUS CASTING APPARATUS. Patent dated July 1, 1980. Disclaimer filed Mar. 5, 1981, by the assignee, *Nassau Recycle Corp.*

Hereby enters this disclaimer to claims 1 through 4 of said patent.

[*Official Gazette April 28, 1981.*]